United States Patent [19]

Shelton

[11] Patent Number: 4,687,006

[45] Date of Patent: Aug. 18, 1987

[54] CIGARETTE FIRE SAFETY APPARATUS

[76] Inventor: Jay W. Shelton, Rt. 7, Box 124JK, Santa Fe, N. Mex. 87501

[21] Appl. No.: 736,070

[22] Filed: May 20, 1985

[51] Int. Cl.[4] ..... A24F 13/16

[52] U.S. Cl. ..... 131/257; 131/260

[58] Field of Search ..... 131/257, 329, 260

[56] References Cited

U.S. PATENT DOCUMENTS

| | | |
|---|---|---|
| 889,207 | 6/1908 | Crane . |
| 1,038,738 | 9/1912 | Fouquier . |
| 1,291,872 | 1/1919 | McGuigan . |
| 2,134,213 | 10/1938 | Skidmore . |
| 2,638,906 | 5/1953 | Schramm . |
| 3,102,543 | 9/1963 | O'Siel et al. . |

FOREIGN PATENT DOCUMENTS

| | | |
|---|---|---|
| 367570 | 2/1932 | United Kingdom . |

*Primary Examiner*—V. Millin

*Attorney, Agent, or Firm*—Samuel M. Freund

[57] ABSTRACT

A cigarette or cigar fire safety apparatus. A fulcrum and a lumped or distributed counterbalancing mass are made integral components of conventional cigarettes and cigars in such a manner that the lighted end of the smoking material is tilted up and out of contact with combustible, essentially horizontal surfaces upon which the lighted materials happen to accidentally be dropped or mistakenly placed. The fulcrum/weighted end combination also reduces the tendency of the cylindrical smoking materials to roll. Furthermore, the fulcrum is collapsable. In another embodiment of the invention, a series of coaxial extensions are placed at various positions along the surface of a cylindrical smoking material whereby the smoking material is kept away from such flammable surfaces by the action of these extensions. As the extensions fall away from the smoking material or are consumed as the combustion process passes their position of attachment, the distance from the surface is maintained or increased until the next to last extension is released from the smoking material. At this point, the lighted end of the smoking material tips up about the last of the extensions which acts as a fulcrum thereby. The placement of the last extension is chosen such that the nonlighted end of the smoking material has greater torque than the remaining lighted poriton. The operation of the present invention is improved if the material between the fulcrum or last extension and the unlighted end of the smoking material does not readily support combustion. The integral design of the invention frees the user from having to remember to install the fire safety device.

8 Claims, 5 Drawing Figures

CIGARETTE FIRE SAFETY APPARATUS

BACKGROUND OF THE INVENTION

The present invention relates generally to fire safety devices and more particularly to the use of a fire safety device to reduce the incidence of fire resulting from cigarettes and cigars coming in contact with flammable surfaces.

There have been numerous inventions relating to self-extinguishing cigarettes, the control of ashes from smoking materials, and the mechanical separation of smoking materials from flammable surfaces. Such inventions either rely on the addition of fire retardant or extinguishing chemicals to the cigarette tobacoo or paper, or on the attachment by the user of a mechanical device to the cigarette to achieve a similar result. Three examples of the latter technique will be briefly presented to illustrate relevent known art. First, U.S. Pat. No. 2,134,213, "Protective Cigarette Holder," issued to F. Skidmore on Oct. 25, 1938 describes a cigarette holder designed to accomodate cigarettes of several different diameters which is able to keep the lighted end of the cigarette held thereby away from combustible surfaces. The device, which essentially covers the cigaratte over its entire length, must be attached by the smoker to each cigarette in order for it to be utilized, however.

U.S. Pat. No. 889,207, "Cigarette Holder" issued to E. T. Crane on June 2, 1908 teaches a cigarette with an integral paper flap at the mouth end to serve as a holder. It is not intended for use as a fire safety device, although it can be folded against the cigarette for close packing in a container.

Finally, U.S. Pat. No. 3,102,543, "Safety Tip Cigarette" issued to O'Siel et al. on Sept. 3, 1963 discloses a safety tip cigarette with a metallic foil band near the mouth end. The band is intended to both shrink when heated in order to extinguish the cigarette when the combustion produces high temperatures in the region of the band, and to adhere to surfaces without a significant amount of motion. However, it does not extend significantly in the radial direction and therefore cannot be expected to raise the burning end of the cigarette sufficiently to diminish the fire hazard. Moreover, there is no teaching for positioning the metal band in order that the mouthpiece end of the cigarette has sufficient weight to tilt the burning end about the metal band.

Several references are concerned with analogous art relating to pens and pencils. The object of these inventions is to prevent ink from leaking onto a surface and to prevent rolling, etc.. For example, U.S. Pat. No. 1,038,738, "Pen And The Like" issued to Paul Jean Forquier on Sept. 17, 1912 discloses a fulcrum at the far end of the pen from the pen tip and a weight for tipping the pen about the fulcrum in such a manner that the pen point will not touch the surface upon which the pen is placed. The projecting fulcrum may be formed integrally with the pen or secured separately.

Further, U.S. Pat. No. 1,291,972, "Pencil and Penholder Attachment" issued to M. J. McGuigan on Jan. 21, 1919 teaches an expandable, slotted elastic sleeve which prevents rolling when in the expanded condition, and also permits close packing with the sleeve collapsed. The sleeve is not designed to protect against ink damage which might occur if the pen is accidentally dropped on a surface which can be damaged. In fact, the patent teaches that the sleeve is to be adjusted to lie flat when the pen or pencil is in use, the sleeve thereby providing a grip for the fingers of the user which would not keep the tip away from a surface upon which the pen happened to be dropped.

Accordingly, an object of my invention is to reduce the incidence of contact of burning tobacco and/or hot ashes with flammable, substantially horizontal surfaces onto which a lighted cigarette or cigar is accidentally dropped or mistakenly placed.

Another object of the present invention is to reduce the likelihood that a dropped cigarette or cigar will roll a significant distance on a substantially horizontal surface such as a seat cushion or a mattress and thereby finds its way into the folds or crevices of a couch, chair or bed.

Yet another object of the present invention is to enable the above-described objects to be accomplished without the smoker having to affix anything to the cigarette or cigar.

Additional objects, advantages and novel features of the invention will be set forth in part of the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, the apparatus of this invention includes a fulcrum attached or formed along the circumference of the outer surface of a conventional cigarette or cigar and extending outward substantially radially therefrom with perhaps a forward or backward lean relative to the nonlighted end of the cigarette, and sufficient weight located towards the nonlighted end of the cigarette or cigar, whereby the weight acts in cooperation with the fulcrum to cause the cigarette or cigar to tilt about the fulcrum in such a manner that the burning end of a lighted cigarette or cigar is raised away from a flammable, eseentially horizontal surface upon which it is accidentally dropped or mistakenly placed by a sufficient amount that ignition of the surface material is prevented, and whereby the rolling path of a cigarette or cigar on a substantially horizontal surface is significantly limited as a result of action of the fulcrum, thereby reducing the likelihood that the cigarette or cigar will roll into a crevice in the surface and initiate combustion therein. In accordance with the teachings of the subject invention, the weight material could either be inside of the cigarette or cigar or a part of the exterior thereof, and could be either a normal part of the cigarette such as a filter or tobacco, or explicit added weight. in the situation where no explicit weight is employed, the requisite torque may be developed by proper choice of fulcrum location along the length of the smoking material. For maximum effectiveness of the present invention, it is preferred that the material between the fulcrum and the nonlighted end of the smoking material not readily support combustion. The fulcrum could lie flat against the outer surface of the cigarette or cigar when the smoking material is tightly packaged, and automatically deploy to its optimal dimension upon removal from the package, or the fulcrums might be fully deployed inside of the package.

In a further aspect of the present invention, in accordance wtih its objects and purposes, the apparatus hereof includes at least two substantially coaxial extensions as an integral part of the tubular smoking material attached or formed along the circumference of the outer surface of the smoking material and extending outward substantially radially therefrom, each of the extensions dividing the smoking material into a mouthpiece segment and a lighted segment, such that as the cigarette is consumed by combustion, each extension touching the surface keeping the burning end above the surface upon which the smoking material happens to be located, each extension dropping off of the smoking material or being consumed when the combustion reaches the location along the surface of the smoking material thereof, and where the nonlighted end of the smoking material has greater weight than the lighted end thereof when the combustion reaches the second from last extension, such that the lighted end of the smoking material tips up about the last extension in such a way that the lighted end is moved away from the surface upon which the smoking material is located, the last extension acting as a fulcrum thereby. It is preferred that the portion of the cigarette in between the fulcrum and the nonlighted end of the cigarette not readily support combustion in order that the present invention attain the maximum effectiveness. Preferably also, the coaxial extensions be of different outer dimensions in order to reduce the distance that the smoking material can roll on a substantially horizontal surface. No more than two of the extensions need touch the surface upon which the smoking material rests at one time. It is also preferred that the nonlighted end of the smoking material have sufficient weight to assist in the desired tipping of the smoking material when the combustion reaches the second from the last of the extensions. The extensions might be designed to lie flat against the outer surface of the smoking material when the smoking material is packaged, and automatically deploy to their optimal size when the smoking material is removed from the package. However, it is possible that a packaging scheme could be devised such that the extensions might be fully deployed inside of the package.

The subject invention then provides an apparatus for reducing the danger of combustion of flammable surfaces when a lighted cigarette or cigar is accidentally dropped or mistakenly placed on such a surface. Rolling of the smoking materials into crevices in the surface is also reduced by my invention which thereby assists in the reduction of fires. A principal feature of the invention is the fact that the smoker does not have to attach an appliance to the smoking material since the present safety apparatus is present in its operable form on the cigarette as manufactured, or automatically deploys upon removal and/or use of the cigarette or cigar from its containing package. This eliminates the shortcomings of many cigarette and cigar fire safety devices and methods where the smoker rarely remembers to install the apparatus.

BRIEF DESCRIPTION OF THE DRAWINGS

The accompanying drawings, which are incorporated in and form a part of the specification, illustrate two embodiments of the present invention and, together with the description, serve to explain the principles of the invention. In the drawings.

DETAILED DESCRIPTION OF THE INVENTION

Reference will now be made in detail to the present preferred embodiment of the invention, an example of which is illustrated in the accompanying drawings. In brief, the present invention teaches the use of at least one radially disposed coaxial extension integral with a cigarette or cigar and intended to be disposable therewith. The coaxial extensions might be capable of being collapsed against the cylindrical outer surface thereof for close packaging of the smoking materials and of automatically expanding to operative condition upon removal of a cigarette or cigar from its package, or be formed in a substantially rigid manner such that they are always in their deployed configuration and packaged in that configuration. In one embodiment of my invention, only one coaxial extension is employed. This extension acts as a true fulcrum for the smoking material at the outset. In accordance with the subject invention, additional counterbalancing mass might be included at the nonlighted end of the smoking material in order to ensure that the lighted end of the cigarette or cigar is raised above potentially combustible surfaces upon which the smoking materials may rest when the second from last coaxial extension is released or consumed as a result of the combustion having reached its position along the cigarette or cigar, or in the situation where only one such extension is employed as a fulcrum. In both cases it is possible to arrange the position of the coaxial extensions and the length of the mouthpiece end of the smoking material so that additional weight is not necessary. Smoking material esthetics, convenience, and manufacturing costs will determine the exact form of my fire safety device. In both cases the burning smoking material will be kept sufficiently far from the surface upon which it rests that danger of combustion from either the burning tobacco or heated ashes therefrom is substantially reduced.

In order to improve the effectiveness of my invention, it is desirable that the material in between the fulcrum (the last extension in the embodiment of my invention where multiple extensions are employed) and the nonlighted end of the smoking material not readily support combustion. Some improvement in the fire safety of smoking materials employing the present invention, however, will automatically occur due to the smaller contact time of burning smoking material with a flammable surface over that if a substantially completely flammable lighted cigarette were permitted to contact the same surface. It should also be mentioned at this point that if the extensions are capable of being consumed in the combustion process, the improved fire safety characteristics of the present invention will not be significantly diminished since their combustible mass and area of contact with the underlying surface are small.

Figure 1:
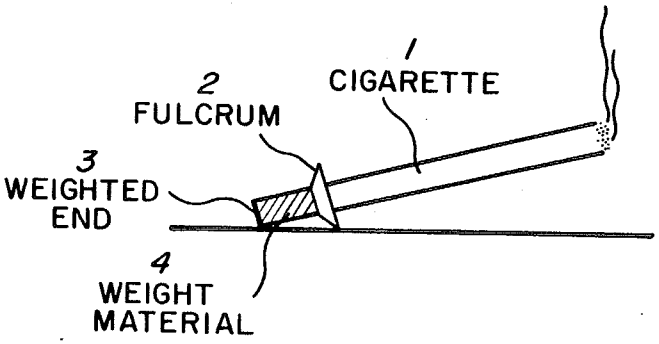
FIG. 1 shows a schematic representation of the fulcrum and weight apparatus of the subject invention as it would be used for conventional smoking materials.

Turning now to the drawings, FIG. 1 shows a schematic representation of the single fulcrum apparatus of the subject invention as it would actually be deployed to protect a flammable surface from the possibility of ignition as a result of a cigarette or cigar accidentally being dropped thereon or being inadvertently placed thereon. A conventional cigarette or cigar 1 including a hollow paper cylinder which encloses shredded tobacco would be adapted to include a fulcrum 2, which extends in a generally radial direction about the cylindrical surface in a substantially circular pattern which is located at a point chosen on this surface to provide the appropriate leverage. Shown in FIG. 1 is a fulcrum with a smooth circular perimeter. The fulcrum 2 would be designed either to remain flat against the cylindrical surface when the smoking materials are tightly packaged for storage or transport and to automatically deploy to form a sturdy tilt position for the cigarette or cigar when removed from its package for use, or to be fully deployed even in its packaged condition. Those skilled in the art would recognize that an annularly shaped "bump" formed on the surface of the cylindrical smoking material would work in accordance with the teachings of my invention. The unlighted side of the fulcrum is the heavier end 3 of the smoking material and could contain a lumped or distributed weight or weights 4. It is possible however, by properly chosing the position of the fulcrum and the length and construction of a filter, to avoid the necessity of additional weight in the nonlighted end of the smoking material, the material thereof providing the required torque. The range of appropriate fulcrum locations is easily determined once the nature of the smoking material is decided upon, and would be readily ascertainable by one of ordinary skill in the art after studying the teachings of the present invention. The results for one such calculation are provided hereinbelow. The heavier end is designed such that the smoking material automatically tilts about the fulcrum in such a way that the lighted end of the cigarette or cigar is lifted away from any substantially horizontal, potentially flammable surface the smoking material is accidentally dropped or inadvertently placed upon, thereby reducing the danger of combustion due to the direct action of the burning tobacco and paper or the heated ashes resulting therefrom on the flammable surface. It is desirable that the unlighted end of the smoking material not readily support combustion, but significant benefit from the use of my invention will be obtained even if this is not the case.

Figure 2:
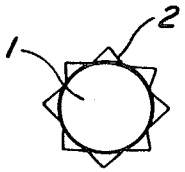
FIG. 2 describes one embodiment of the fulcrum of the apparatus of the subject apparatus.
Figure 3:
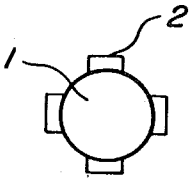
FIG. 3 shows a second embodiment of the fulcrum of the subject apparatus.

FIGS. 2 and 3 show two other possible fulcrum configurations which would achieve the objects of my invention. In particular, it is desired that the possibility of the smoking materials' rolling into crevices in the surface upon which they are located. The substantially radial extensions shown in FIGS. 2 and 3 are designed to reduce the tendency of rolling for smoking materials tilted about a fulcrum of the design illustrated, or, at the very least, to essentially confine the path of the movement of the cigarette or cigar to a circle of substantially short radius. A circular, substantially smooth perimeter fulcrum design as is shown in FIG. 1 could perform the latter required function in a similar manner.

Figure 4:
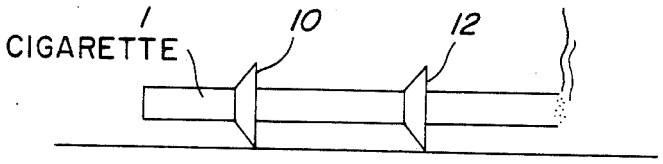
FIG. 4 shows a schematic representation of the multiple coaxial extensions apparatus of the subject invention as it would be used for conventional smoking materials.
Figure 5:
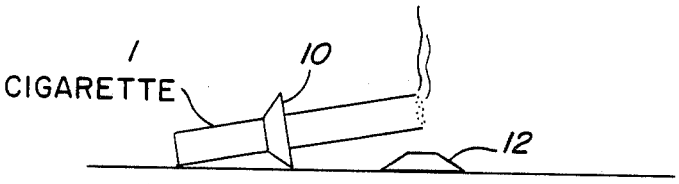
FIG. 5 shows the fulcrum effect of the multiple coaxial extensions apparatus of the subject invention when the second from last extension is released or consumed due to the combustion of the smoking material.

FIGS. 4 and 5 show schematically the multiple coaxial extension embodiment of the subject invention. FIG. 4 demonstrates the manner in which the burning end of a cigarette or cigar is kept above a flammable surface with two such extensions 10, 12, while FIG. 5 shows the fulcrum effect about the last of the coaxial extensions 10 which occurs after the second from last extension 12 (in this case, the first of two extensions) is released from the smoking material by the combustion process. Shown in these figures are circular coaxial extensions which lean forward as they extend radially from the surface of the cigarette. In accordance with my invention, the coaxial extensions might be of unequal outer diameters. This would reduce the distance the smoking material could roll on a substantially horizontal surface.

Possibilities for generating the required torque by the heavier end of the cigarette or cigar include simple placement of the fulcrum or coaxial extension, or the use of iron or other dense materials in the shape of rings, rods and the like, or in a distributed configuration as small pieces or particles. Sand might be used for the latter embodiment, for example. Encapsulated water in small plastic containers might be an alternative for use in the lumped weight embodiment of my invention. Such an apparatus might reduce the flammability of the unlighted end of the smoking material. Considerations of smoker safety and pleasure, in addition to environmental protection somewhat restrict the overall number of choices for materials. The smoking materials' ultimate size and cost are other considerations on weight design. Simple calculations demonstrate that if a tobacco density of 0.25 g/cc, which is a typical value for this quantity, is assumed, the following relationships obtain:

| mouthpiece density / tobacco density | mouthpiece length / tobacco length |
|---|---|
| 4 | 0.5 |
| 2 | 0.71 |
| 1 | 1 |

where the mouthpiece density appearing in the mouthpiece density/tobacco density ratio, and the mouthpiece length appearing in the mouthpiece length/tobacco length ratio refer to the density and length of material on the mouthpiece side of the fulcrum, respectively, when a distributed mass is utilized. These densities and lengths are readily achievable without major modification of the design of conventional smoking materials using easily obtainable materials for weight. Similarly, cellulose or plastic could be used for collapsible fulcrums, both materials being readily available and having the requisite springiness. Permanent bulges formed in the surfaces of the smoking materials or from a fitler could also provide the requisite coaxial extensions for the multiple extension embodiment of my invention or for the single fulcrum embodiment.

Some of the embodiments of the present invention reduce the tendency of conventional smoking materials to roll on a flammable surface by virtue of a series of substantially radial projections emerging from the cylindrical surface as in FIGS. 2 and 3. Even a single, smooth, circular fulcrum limits the extent of rolling of smoking materials provided that the slope of the surface upon which the cigarette or cigar is located is not too steep. According to the teachings of my invention, cylindrical smoking materials having at least two coaxial extensions also have restricted travel on such surfaces if the extensions have different outer diameters. All embodiments of my invention tend to hold the burning end of the smoking materials away from surfaces, both horizontal and vertical, even if the smoking material happens to reach a crevice or welt cord, without requiring the user to remember to install or remove an attachment to his or her cigarette or cigar.

The foregoing description of two preferred embodiments of the invention have been presented for the purpose of illustration and description. They are not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What I claim is:

1. An apparatus for reducing the danger of fire from lighted cylindrical smoking materials such as cigarettes and cigars, which comprises in combination:

a. a fulcrum which is an integral part of the cylindrical smoking material and divides the cylindrical smoking material into two segments, one segment being designated the mouthpiece segment does not readily support combustion, said fulcrum being located along a circumference of the outer surface of the cylindrical smoking material and extending outward substantailly radially therefrom, said fulcrum further lying substantially flat against the outer surface of the cylindrical smoking material when the cylindrical smoking material is packaged, and automatically deploying to substantially the optimal size thereof upon removal of the cylindrical smoking material from the package; and b. weight, comprising at least one lumped mass, located inside of the mouthpiece segment of the cylindrical smoking material such that said weight, in cooperation with said fulcrum, causes the cylindrical smoking material to tilt about said fulcrum when the cylindrical smoking material comes in contact with a substantially horizontal surface, whereby the burning end of the lighted cylindrical smoking material is sufficiently raised from the surface to prevent ignition of the surface material, and whereby the rolling path of the cylindrical smoking material is signficantly limited.

2. An apparatus for reducing the danger of fire from lighted cylindrical smoking materials such as cigarettes and cigars, said apparatus comprising in combination at least two substantially coaxial extensions, said at least two coaxial extensions being an integral part of the smoking material attached along at least a part of the circumference of the outer surface of the smoking material and extending outward substantially radially therefrom, each of said at least two coaxial extensions dividing the smoking material into two segments, one segment being designated the mouthpiece segment and the other segment being designated the lighted segment, such that as the smoking material is consumed by combustion, each of said at least two coaxial extensions maintains the lighted segment above the surface upon which the smoking material is located, each of said at least two coaxial extensions being released from the smoking material as a result of the combustion process when the combustion reaches the location along the surface of the smoking material thereof, and wherein the location of the one of said at least two coaxial extensions closest to the nonlighted end of the smoking material, which shall be designated as the fulcrum, is chosen such that the mouthpiece segment of the smoking material has greater torque than the lighted segment thereof when the combustion process releases the one of said at least two coaxial extensions nearest to said fulcrum, such that the lighted segment of the smoking material tips up about said fulcrum in such a way that the lighted segment is moved away from the surface upon which the smoking material is located.

3. The apparatus as described in claim 2, wherein the mouthpiece segment of the smoking material includes weight material to assist in the tipping of the smoking material about said fulcrum when the combustion process releases the one of said at least two coaxial extensions nearest to said fulcrum, thereby permitting said fulcrum to be located closer to the nonlighted end of the smoking material, and wherein the mouthpiece segment of the smoking material between said fulcrum and the nonlighted end of the smoking material does not readily support combustion.

4. The apparatus as described in claim 3, wherein said at least two coaxial extensions have annular cross sections, and wherein said at least two coaxial extensions have substantially continuous circular outer perimeters.

5. The apparatus as described in claim 3, wherein said at least two coaxial extensions have non-circular outer perimeters, whereby rolling of the smoking material on a surface is reduced.

6. The apparatus as described in claim 3, wherein those of said at least two coaxial extensions which are located between said fulcrum and the lighted end of the smoking material and closer to said fulcrum have larger outside dimensions than those of said at least two coaxial extensions which are located farther away from said fulcrum, thereby limiting the amount of rolling of the smoking material possible on a substantially horizontal surface.

7. The apparatus as described in claim 6, wherein said fulcrum lies flat against the outer surface of the smoking material when the smoking material is packaged, and automatically deploys to its optimal size upon removal of the smoking material from the package.

8. An apparatus for reducing the danger of fire from lighted cylindrical smoking materials such as cigarettes and cigars, which comprises in combination:

a. a fulcrum which is an integral part of the cylindrical smoking material and divides the cylindrical smoking material into two segments, one segment being designated the mouthpiece segments does not readily support combustion, said fulcrum being located along a circumference of the outer surface of the cylindrical smoking material and extending outward substantially radially therefrom, said fulcurm further lying substantially flat against the outer surface of the cylindrical smoking material when the cylindrical smoking material is packaged, and automatically deploying to substantially the optimal size thereof upon removal of the cylindrical smoking material from the package; and b. weight, comprising distributed mass, located inside of the mouthpiece segment of the cylindrical smoking material such that said weight, in cooperation with said fulcrum, causes the cylindrical smoking material to tilt about said fulcrum when the cylindrical smoking material comes in contact with a substantially horizontal surface, whereby the burning end fo the lighted cylindrical smoking material is sufficiently raised from the surface to prevent ignition of the surface material, and whereby the rolling path of the cylindrical smoking material is signficantly limited.

* * * * *